US007304260B2

(12) United States Patent
Boller et al.

(10) Patent No.: US 7,304,260 B2
(45) Date of Patent: Dec. 4, 2007

(54) SYSTEM AND METHOD FOR FILLING, REMOVING AND TRANSPORTING CONTAINERS

(75) Inventors: Manfred Boller, Hohentengen (DE); Wilhelm Maler, Wettingen (CH)

(73) Assignee: Siemens Schweiz AG, Zürich (CH)

( * ) Notice: Subject to any disclaimer, the term of this patent is extended or adjusted under 35 U.S.C. 154(b) by 373 days.

(21) Appl. No.: 10/668,971

(22) Filed: Sep. 24, 2003

(65) Prior Publication Data

US 2004/0074561 A1 Apr. 22, 2004

Related U.S. Application Data

(63) Continuation of application No. PCT/EP02/00698, filed on Jan. 24, 2002.

(30) Foreign Application Priority Data

Mar. 24, 2001 (EP) ..... 01107338

(51) Int. Cl.
*B07C 5/00* (2006.01)

(52) U.S. Cl. ..... 209/584; 209/900; 198/370.02; 198/468.9

(58) Field of Classification Search ..... 209/584, 209/900, 509, 702, 706; 414/280; 198/370.01, 198/370.02, 370.03, 370.07, 370.09, 468.11
See application file for complete search history.

(56) References Cited

U.S. PATENT DOCUMENTS 3,184,061 A * 5/1965 Levy ..... 209/552
3,757,939 A * 9/1973 Henig ..... 209/584
4,468,165 A * 8/1984 Kawasaki ..... 414/403
4,518,160 A 5/1985 Lambrechts
5,135,344 A * 8/1992 Kita et al. ..... 414/273
5,174,454 A * 12/1992 Parkander ..... 209/3.3
5,380,139 A * 1/1995 Pohjonen et al. ..... 414/280
5,385,243 A * 1/1995 Jackson et al. ..... 209/509
6,079,570 A * 6/2000 Oppliger et al. ..... 209/630
6,126,017 A * 10/2000 Hours ..... 209/698
6,201,203 B1 * 3/2001 Tilles ..... 209/584

(Continued)

FOREIGN PATENT DOCUMENTS

DE 199 01 444 C1 2/2000

(Continued)

OTHER PUBLICATIONS

Derwent Abstract—DE 19901444C1; Feb. 24, 2000; Slemens AG, D-80333 München.

(Continued)

*Primary Examiner*—Patrick Mackey
*Assistant Examiner*—Mark Hageman

(57) ABSTRACT

The present invention relates to a system and method for automatically transporting receiving containers for sorted products. The containers are filled with the sorted products along a sorting stretch at individual, similar target stations, and automatically transported by means of a transport device after being filled. A full receiving container for sorted products is thus lowered, after a transport command has been triggered, by means of a transport device beneath a target station. The container is then placed on the transport device, if the device is not already occupied by a receiving container. The receiving container is then transported away from the target station by means of the transport device.

3 Claims, 4 Drawing Sheets

U.S. PATENT DOCUMENTS

| | | | | |
|---|---|---|---|---|
| 6,276,509 | B1 * | 8/2001 | Schuster et al. | 198/370.02 |
| 6,316,741 | B1 * | 11/2001 | Fitzgibbons et al. | 209/584 |
| 6,431,369 | B1 * | 8/2002 | Boller et al. | 209/615 |
| 6,561,339 | B1 * | 5/2003 | Olson et al. | 198/349 |
| 6,561,360 | B1 * | 5/2003 | Kalm et al. | 209/606 |
| 6,923,612 | B2 * | 8/2005 | Hansl | 414/277 |
| 7,012,211 | B2 * | 3/2006 | Brinkley et al. | 209/584 |
| 2003/0006174 | A1 * | 1/2003 | Harres et al. | 209/584 |
| 2003/0141226 | A1 * | 7/2003 | Morikawa | 209/584 |

FOREIGN PATENT DOCUMENTS

| | | |
|---|---|---|
| FR | 2 680 121 | 2/1993 |
| WO | WO 99/34936 | 7/1999 |

OTHER PUBLICATIONS

Derwent Abstract—FR 2 680 121; Feb. 12, 1993; S.A. Bertin & Cie.

* cited by examiner

SYSTEM AND METHOD FOR FILLING, REMOVING AND TRANSPORTING CONTAINERS

CROSS REFERENCE TO RELATED APPLICATIONS

The present application is a continuation of international patent application number PCT/EP02/00698, filed on 24 Jan., 2002, which designated the United States and further claims priority to European patent application 01107338.4, filed on 24 Mar. 2001.

| APPLICANTS | |
|---|---|
| Manfred Boller | Wilhelm Maier |
| Marktweg 5 | Neufeldstrasse 13b |
| D-79801 Hohentengen | CH-5430 Wettingen |
| Germany | Switzerland |
| German Citizen | Swiss Citizen |

BACKGROUND OF THE INVENTION

The present invention relates to a system and method for the filling, automatic removal, and transportation of receiving containers for sorted items. The containers are filled at individual destination points with sorted items. The sorted items may be the same, similar or different to one another. The destination points are located along a sorting path. After filling, the containers are transported away from the destination points by way of a transport facility.

German reference DE 19961513C1 sets out a sorting system for flat shipping items such as letters, cards, and the like. The system makes use of a conveyor system which guides containers along a sorting path and employs a succession of destination points arranged along the path. The destination points run crosswise with respect to the direction of conveyor travel.

In sorting systems for flat shipping items, the items are sorted by destination locations or destination address into destination pockets arranged along the sorting path. The destination pockets are referred to as destination points. During the course of sorting operations, as soon as a destination pocket or destination point is filled with items, the destination pocket must be emptied. During emptying operation, the letters are manually removed from the destination pocket and placed into a receiving container for sorted items which is located on a holder. Each destination point has such a receiving container for sorted items. For filling purposes, the container is withdrawn crosswise with respect to the sorting path. During withdrawal, the operator stands to the side of the container in front of the preceding or subsequent destination point. A plurality of filling operations may be required in order to completely fill a container.

As soon as the receiving container for sorted items has been completely filled, it must be taken away. This is also performed manually. The filled receiving container for sorted items is lifted and may be placed on a conveyor belt lying opposite or on a shelf. This activity is physically tiring on account of the weight of the receiving container for sorted items as well as the bending and flexing necessary by the operator.

Patent reference DE 199 01 444 C1 describes a transport facility for receiving containers for sorted items. The facility transports the receiving containers for sorted items, loaded from the destination points, into a shelf-type assembly which is secured to a traveling carriage capable of traveling along a series of destination points of a sorting machine. The destination points lay side by side. According to this facility, if for example a first receiving container for sorted items is to be filled several times at a first destination point and after the first filling operation a second receiving container for sorted items is to be filled at a second destination point, then the first receiving container for sorted items must be lifted from the transport facility and stored temporarily in order to create space for the second receiving container for sorted items which can then be moved onto the transport facility. This operation is performed manually.

BRIEF SUMMARY OF THE INVENTION

An object of the present invention is a system and method which may be used to achieve an improvement in container handling during filling of the receiving containers for sorted items. Another object of the present invention is an improved level of automation for the transportation of the receiving containers for sorted items.

These and other objects are achieved by the present invention which includes a method for the filling and for the automatic transportation of receiving containers for sorted items by the following method steps:

A: an empty receiving container for sorted items is placed on a holder and inserted together with the latter beneath the destination point on a guide;

B: the receiving container for sorted items is withdrawn at least once for filling with sorted items crosswise with respect to the sorting path and in the reverse direction to insertion and is inserted again after a filling operation;

C: following a control command the receiving container for sorted items is raised from the holder by means of a lift;

D: the holder of the receiving container for sorted items is withdrawn in the opposite direction to insertion;

E the receiving container for sorted items is lowered by means of a lift onto the transport facility situated beneath the destination point and transported away; and F: the lift is moved to its idle position.

The present objects are also achieved with a system for filling, automatically removing, and transporting of receiving containers which is designed such that a guide for moving the receiving containers into and out of a filling position, a lifting system for lifting a filled receiving container from the holder, and a facility for lowering the receiving containers onto the transport facility, are provided beneath the destination points.

In this situation, a receiving container is moved from a filling position into a ready position beneath the destination point and vice versa. After the receiving container has been filled, it is moved from the filling position into a ready position. As a result, the space at the filling position of the respective destination point is released for emptying the sorted items from the sorting pockets of the upstream or downstream sorting positions.

In order to accommodate and move the receiving container, a holder is provided which is moved on a guide beneath the destination point. A handle is preferably provided for insertion and withdrawal of the holder.

With the aid of an actuation element, a control command can be initiated for removal and transportation of the receiving containers. In addition, a facility for raising and lowering the receiving containers is provided and is referred to hereinafter as a lift. The lift raises the receiving container from the ready position, whereby the holder can be pulled back into the filling position and subsequently the receiving container can be lowered onto the transport facility. In this situation, care should be taken to ensure that no further receiving container is located on the transport facility beneath the destination point.

Control elements are provided in order to guarantee a controlled removal of the receiving container. In order to ensure that the control facility for the removal and transportation of the receiving containers following initiation of the control command detects the presence of the receiving container, at least one control element for detecting the presence of the receiving container is provided in the ready position.

In addition, at least one control element for detecting the uppermost position of the lift is provided. When the lift stops, the holder can be moved into the filling position and subsequently the lowering operation can take place. In order to prevent a collision involving the receiving container as it is being lowered with the holder, at least one further control element is required for detecting the holder in the filling position.

At least one further control element is provided for detecting the lowermost position of the lift. The lift is stopped at its lowermost position, the container is placed on the transport facility and the latter is activated.

In order to ensure that no container is located beneath the respective destination point at which a receiving container for sorted items is to be lowered, at least one control element is provided for controlling and monitoring the transportation of the receiving container for sorted items on the transport facility. The at least one control element is arranged at the end or the beginning of a section of the transport facility. In this situation, a specific number of destination points comprise one transport facility section. The control system can thus determine how many containers have been lowered in the respective transport facility section and removed, and thus ascertain whether a receiving container for sorted items is situated beneath a destination point.

After a lowering operation for a receiving container has taken place, the lift returns to its idle position. At least one control element is provided for detecting this idle position.

The following advantages can be attained by using the method and the aforementioned system:

i) for the filling and transporting of the receiving containers, the receiving containers only need to be moved once whereby empty receiving containers for sorted items are placed on the holder;

ii) the manual transportation of the filled heavy receiving containers is dispensed with; this therefore results in considerably simplified container handling;

iii) receiving containers are directly transported away locally (beneath the sorting path); the space for an additional conveyor belt can be saved since the conveyor belt is integrated directly into the equipment; and iv as a result of automation, the filled receiving containers for sorted items are transported away more quickly.

The present invention further comprises a method for filling, removing, and transporting a receiving container for sorted items, a number of which are filled along a sorting path with sorted items at individual destination points (sorting items being of the same type) and after filling are transported away from the destination points by way of a transport facility, comprising the steps of: placing an empty receiving container on a holder; inserting the container and holder on a guide beneath a destination point; withdrawing the receiving container and holder at least once for filling with sorted items, a withdrawing direction being crosswise with respect to a sorting path direction and opposite to an insertion direction; reinserting the container and holder after the filling; raising the container from the holder in response to a control command, the raising being performed by a lift; withdrawing the holder in the opposite to an insertion direction; lowering the receiving container via the lift onto the transport facility situated beneath the destination point; transporting the receiving container away from the destination point via the transport facility; and moving the lift into an idle position.

The present invention further comprises a system A system for filling, removing, and transporting a receiving container for sorted items, comprising: a sorting path along which the container can be filled with the sorted items; a plurality of destination points positioned along the sorting path, the destination points providing the sorting items to the container; a transport facility located proximate to the sorting path and destination points, the transport facility transporting the container from a destination point; a holder for accommodating the container therein; a guide facilitating lateral movement of the holder beneath the destination point and position the container in and out of a filling position, the filing position being a position wherein the container can be filled with the sorted items; and a lift located proximate to the container, the lift facilitating raising and lowering of the container from the holder to the transport facility.

BRIEF DESCRIPTION OF THE SEVERAL VIEWS OF THE DRAWINGS

The novel features believed characteristic of the invention are set out in the claims below. The invention itself, however, as well as other features and advantages thereof, are best understood by reference to the detailed description, which follows, when read in conjunction with the accompanying drawing, wherein:

DETAILED DESCRIPTION OF THE INVENTION

The method and the system are described in the following with reference to an exemplary letter sorting system in which letter items are sorted according to their destination locations (address) into pockets arranged along a sorting path.

Figure 1:
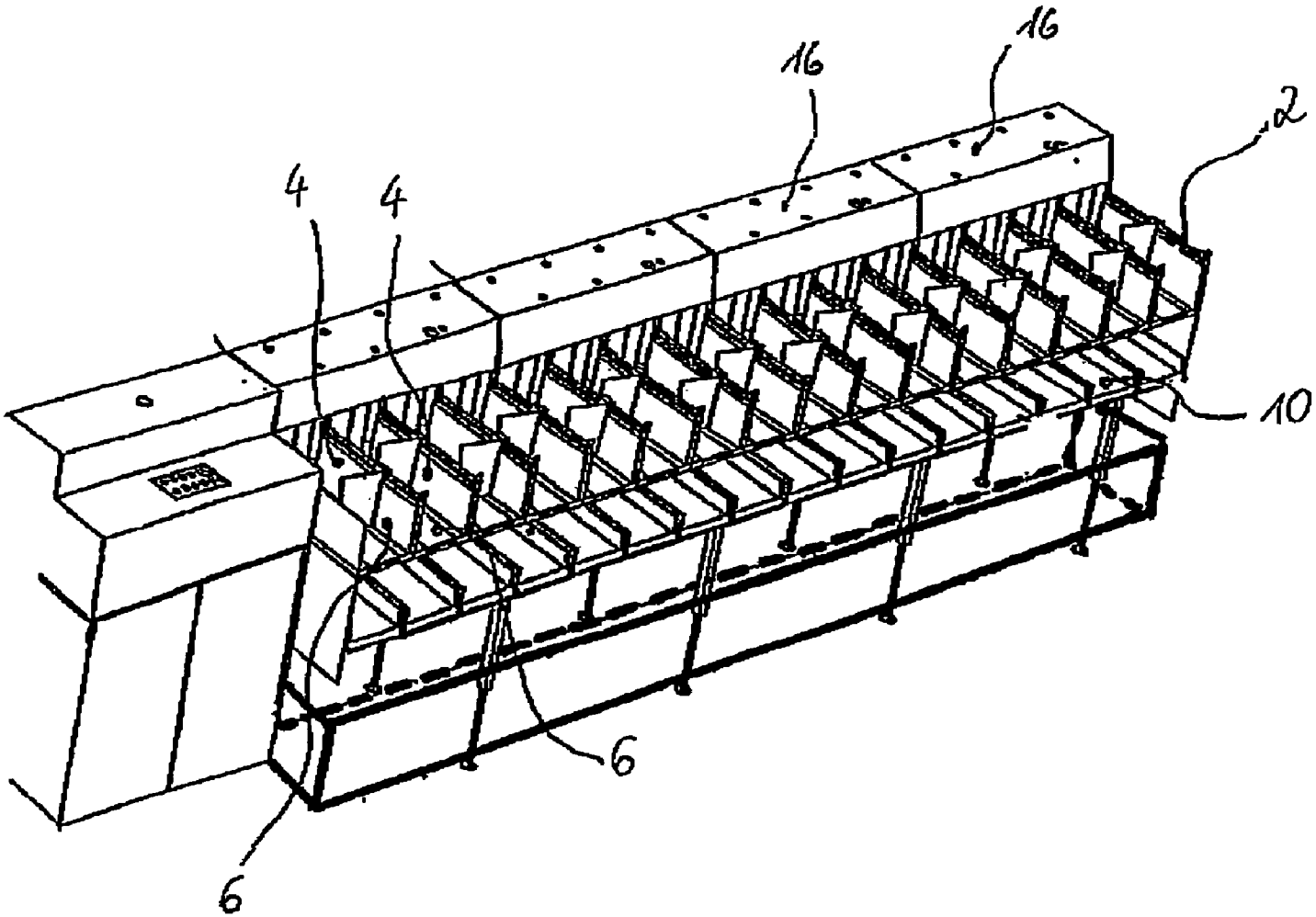
FIG. 1 depicts a sorting path with individual destination points arranged one after the other.
Figure 2:
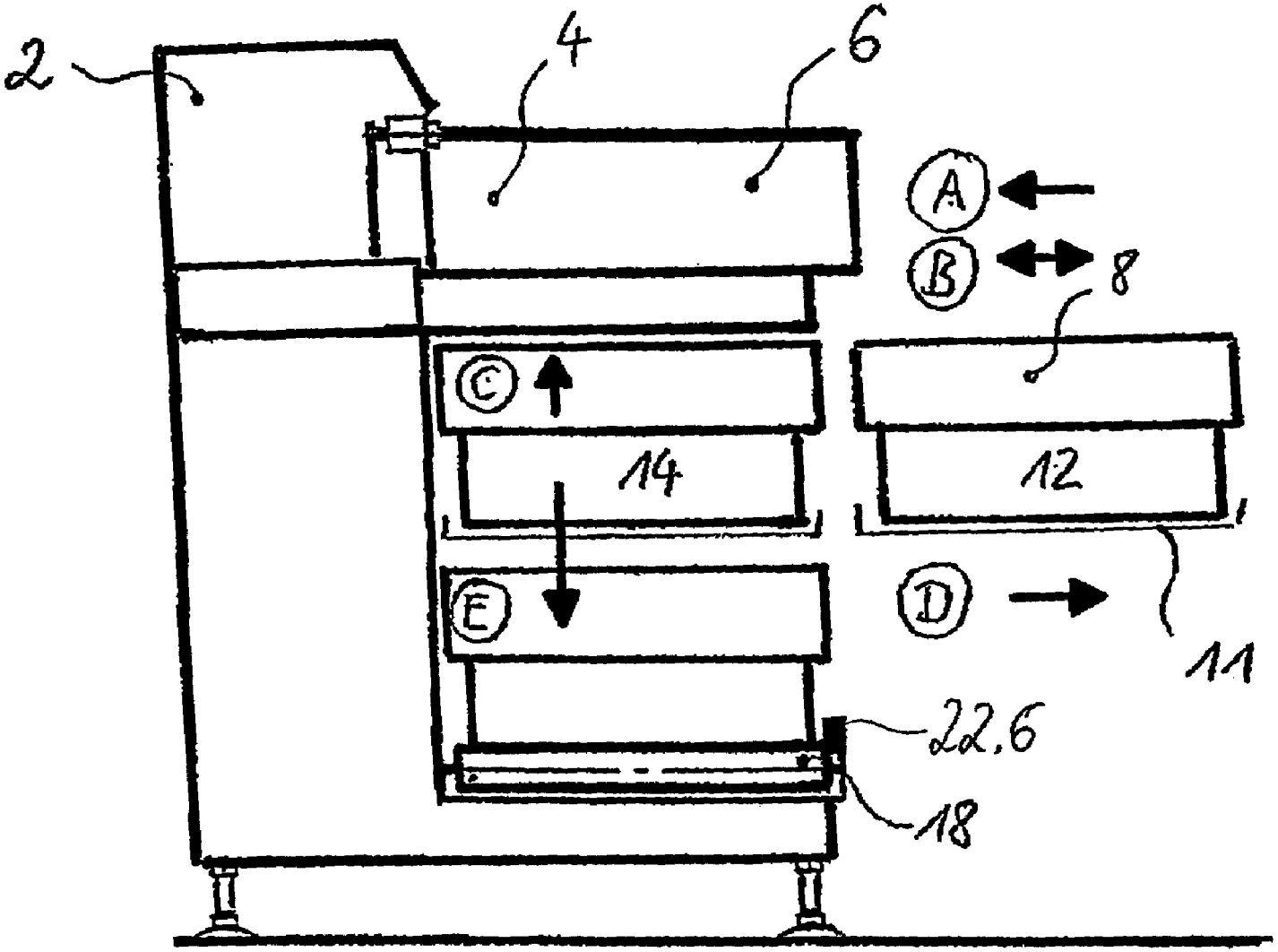
FIG. 2 depicts positions of the system corresponding to the method steps for the filling and automatic removal and transportation of the receiving containers.
Figure 3:
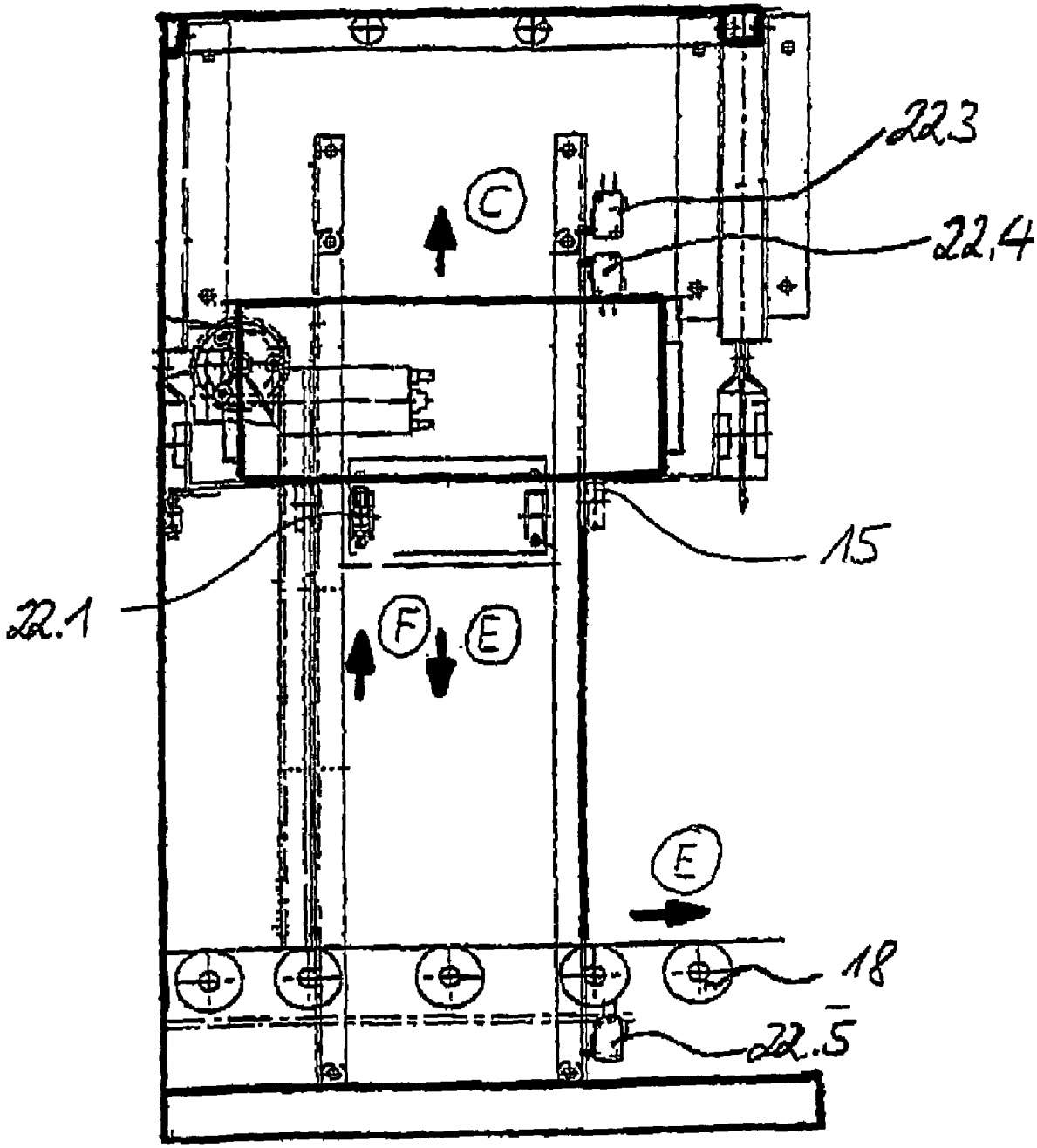
FIG. 3 depicts a side perspective view of the system for the filling and automatic removal and transportation of the receiving containers.
Figure 4:
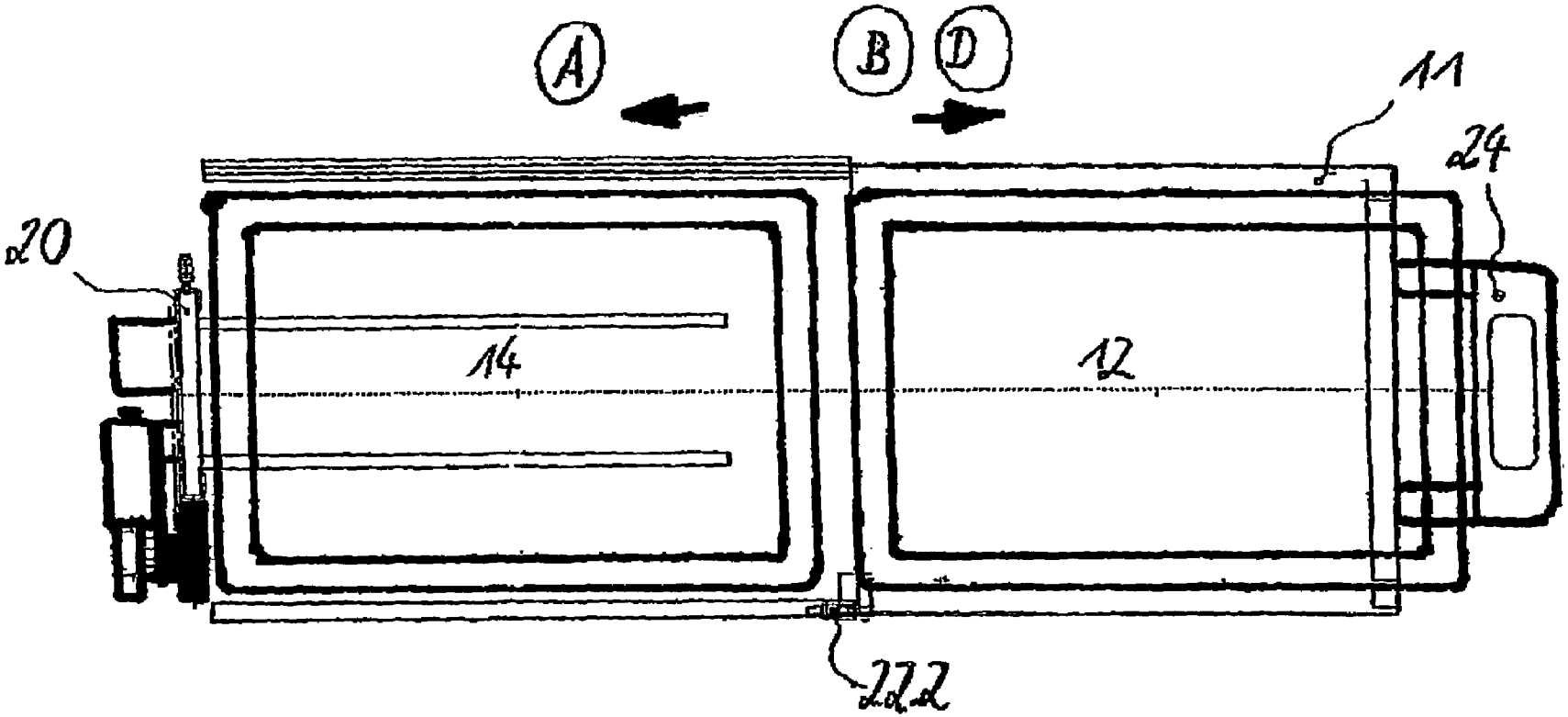
FIG. 4 depicts a top view of the system for the filling and automatic removal and transportation of the receiving containers.

FIG. 1 depicts a schematic representation of a sorting path 2 with individual destination points 4 arranged one after the other. FIGS. 2 and 3 depict the positions corresponding to the different method steps which are labeled A, B, C, D, E, and F. FIG. 3 depicts a side perspective view of the system for the filling and automatic removal and transportation of the receiving containers S. FIG. 4 depicts a top view of the system for the filling and automatic removal and transportation of the receiving containers 8.

Letters are sorted into destination points 4 along a sorting path 2. In this situation, the letters arrive in sorting pockets 6 at the destination points 4.

As shown in FIG. 2, an empty receiving container 8 for sorted items is placed on a holder 11 and the two are moved together under the destination point 4 on a guide 10. FIG. 2 depicts the holder 11 for the receiving container 8 and FIG. 4 depicts the guide 10.

The holder 11 can be moved from a filling position 12 into a ready position 14 under the destination point 4 and vice versa. This is illustrated in FIG. 2 by means of the labeled positions for method steps A and B.

The receiving containers 8 for sorted items are filled manually with sorted items from the sorting pockets 6 at the destination points 4 on the sorting path 2. For filling purposes, the holder 11 with the receiving container 8 located on it is withdrawn crosswise with respect to the sorting path 2. In this situation, the operator stands to the side of the receiving container 8 and in front of the preceding or following destination point 4.

A plurality of filling operations may be required until a receiving container 8 is completely filled, In order to fill the receiving container 8 at the following destination point 4*b*, the receiving container 8 from the preceding destination point 4*a* is moved into the ready position 14 under the following destination point 4*b*. Space is thus created for emptying the following destination point 4 and for filling the associated receiving container 8. The holder 11 can be moved with the aid of a handle 24 (FIG. 4).

If a filled receiving container 8 for sorted items is now ready to be transported away, it is moved on the holder 11 into the ready position 14. This movement is illustrated in FIG. 2 by means of the position of the method step A.

A control command is now initiated by way of an actuation element for transporting away the receiving containers 8. Control elements 22 guarantee fault-free removal of the receiving containers 8. The positions of the individual control elements 22 are illustrated in FIGS. 2, 3 and 4. At least one control element 22.1 is provided for detecting the presence of the receiving container 8 for sorted items in the ready position 14.

After initiation of the control command for the removal and transportation of the receiving container 8 and of the acknowledgment of the presence of the receiving container 8 in the ready position 14 from the control element 22.1, a lift 20 (FIG. 4) raises the receiving container 8 as far as an upper lift position which is detected by at least one control element 22.3. The lift 20 is stopped. FIG. 2 illustrates this position in the method step by means of the letter C.

The holder 11 is now moved without the receiving container 8 into the filling position 12. This is shown in FIG. 2 by the position after method step D.

A control element 22.2 signals when the holder 11 is situated in the filling position 12. The receiving container 8 can not be lowered until both the holder 11 is situated in the filling position 12 and also no further receiving container 8 is located beneath the destination point 4 on the transport facility 18.

The latter will be the case if a lowered receiving container 8 has already been transported on the transport facility 18 from a destination point 4 situated upstream.

In order to avoid the need to monitor all destination points 4, a particularly advantageous embodiment of the invention provides a control mechanism for a plurality of destination points. A specific number of destination points 4 comprise one transport facility section 16. For each of these transport facility sections 16, at least one control element 22.6 is provided at the beginning and/or end, which registers the receiving containers 8 that have traveled through and/or left the transport facility section 16 (path tracking). In other words, as soon as the transport facility 18 has been put into operation at the destination point 4 after the lowering of one or more receiving containers 8, the transport facility 18 must be run completely empty until the receiving container 8 for the corresponding destination point 4 has been transported away. In this situation, the number of receiving containers 8 on the transport facility 18 must be known to the control system.

If the two aforementioned prerequisites are satisfied, the lift 20 lowers the receiving container 8 onto the transport facility 18. At least one control element 22.5 signals the lowermost position of the lift 20. The lift 20 is stopped and the transport facility 18 is activated. This is shown by means of the position E after this method step in FIGS. 2 and 3.

The lift 20 subsequently travels back to the idle position 15 which is detected with the aid of at least one control element 22.4. This is illustrated by means of the position of the method step F in FIG. 3.

A further empty receiving container 8 can be placed on the holder 11 situated in the filling position 12.

In order to prevent the holder 11 from being moved into the ready position 14 too early (for example, if a receiving container 8 is still situated under the destination point 4), the system according to the invention provides two protection mechanisms. On the one hand, a signaling system signals that the removal of the full receiving container 8 has taken place. On the other hand, the movement of the holder 11 into the ready position 14 is blocked during the removal and transportation operation. The blocking can be implemented, for example, with the aid of an electromagnet.

An advantageous means of communication with the control system includes a combination of actuation elements and signal elements. A light pushbutton, for example, could be used to signal the following states of the control system:

| | |
|---|---|
| Light off: | no action by control system; |
| Light on: | removal and transportation of receiving container 8 for sorted items has been initiated; |
| Light flashing: | fault in procedure. |

The color of the light signal can be adapted to suit the respective state of the control system. For example, green signals a start of the operation and red a possible fault in the procedure and/or a stop to the operation. By using an additional actuation element, it is possible to interrupt or undo an already initiated operation.

The invention being thus described it will be obvious that the same may be varied in many ways. The variations are not to be regarded as a departure from the spirit and scope of the invention, and all such modifications as would be obvious to one skilled in the art are intended to be included within the scope of the following claims.

We claim:

1. A method for filling, removing, and transporting a receiving container for sorted items, a number of which are filled along a sorting path with sorted items at individual destination points, the sorting items being of the same type, and alter filling are transported away from the destination points by way of a transport facility, comprising the steps of:

placing an empty receiving container on an upper surface of a holder;

inserting the empty receiving container and the holder on a guide beneath a destination point;

withdrawing the receiving container and the holder at least once for filling with sorted items so that the receiving container is removed from beneath the destination point during filling, a withdrawing direction being crosswise with respect to a sorting path direction and opposite to an insertion direction;

reinserting the container and holder after the filling so that the container is positioned beneath the destination point;

raising the container from the holder in response to a control command, the raising being performed by a lift;

withdrawing the holder in an opposite direction to an insertion direction;

lowering the receiving container via the lift onto the transport facility situated beneath the destination point;

transporting the receiving container away from the destination point via the transport facility; and moving the lift into an idle position.

2. The method according to claim 1, further comprising the step of replacing the container with another container at the destination point.

3. The method according to claim 1, further comprising the steps of:

prior to the step of lowering, determining if a space below the container is occupied, and if the space is occupied, not performing the step of lowering.

* * * * *